US009481099B2

(12) United States Patent
Gingrich

(10) Patent No.: US 9,481,099 B2
(45) Date of Patent: Nov. 1, 2016

(54) BLADE COVER

(71) Applicant: The Boeing Company, Chicago, IL (US)

(72) Inventor: Thomas A. Gingrich, Mesa, AZ (US)

(73) Assignee: The Boeing Company, Chicago, IL (US)

( * ) Notice: Subject to any disclaimer, the term of this patent is extended or adjusted under 35 U.S.C. 154(b) by 97 days.

(21) Appl. No.: 14/039,361

(22) Filed: Sep. 27, 2013

(65) Prior Publication Data

US 2015/0033919 A1 Feb. 5, 2015

Related U.S. Application Data

(60) Provisional application No. 61/862,354, filed on Aug. 5, 2013.

(51) Int. Cl.
*B26B 29/02* (2006.01)

(52) U.S. Cl.
CPC ..... *B26B 29/025* (2013.01); *B26B 29/02* (2013.01); *Y10T 83/04* (2015.04)

(58) Field of Classification Search
CPC ..... B26B 29/00; B26B 29/02
See application file for complete search history.

(56) References Cited

U.S. PATENT DOCUMENTS

| | | | | |
|---|---|---|---|---|
| 3,409,981 | A * | 11/1968 | Beverly | B26B 21/12 30/30 |
| 3,457,643 | A | 7/1969 | Hill | |
| 4,071,952 | A * | 2/1978 | Meshulam | B26B 29/025 30/151 |
| 4,601,102 | A | 7/1986 | Phillips | |
| 4,707,920 | A | 11/1987 | Montgomery | |
| 6,964,100 | B1 * | 11/2005 | Musland | 30/286 |
| 7,155,795 | B2 | 1/2007 | Abidin et al. | |
| 7,900,363 | B1 * | 3/2011 | White | 30/340 |
| RE42,507 | E | 6/2011 | Wilkinson et al. | |
| 2005/0150115 | A1 * | 7/2005 | Hanna | B26B 1/04 30/155 |
| 2007/0163129 | A1 * | 7/2007 | Vogelgesang | B27B 9/02 30/377 |

FOREIGN PATENT DOCUMENTS

| | | |
|---|---|---|
| EP | 0984848 | 8/2001 |
| GB | 2 350 578 | 12/2000 |

OTHER PUBLICATIONS

"Safe Handling of Swann-Morton Products," www.swann-morton.com (2013).
"Doodles from the margin of . . . [Xacto Improvement]," www.fueledbycoffee.com.
International Search Report and Written Opinion, PCT/US2014/041298 (2014).

* cited by examiner

*Primary Examiner* — Sean Michalski
*Assistant Examiner* — Liang Dong
(74) *Attorney, Agent, or Firm* — Walters & Wasylyna LLC

(57) ABSTRACT

A blade cover may include a cover body defining an interior volume, the cover body being configured to receive a cutting implement within the interior volume, a recess is disposed in the cover body, and a slot is disposed through the recess, the slot defining an opening into the interior volume, wherein the slot is configured to receive at least a portion of a blade of the cutting implement and the recess is configured to expose at least a portion of the blade of the cutting implement.

19 Claims, 7 Drawing Sheets

BLADE COVER

PRIORITY

This application claims priority from U.S. Ser. No. 61/862,354 filed on Aug. 5, 2013.

FIELD

The present disclosure is generally related to cutting implements and, more particularly, to a blade cover configured to partially expose a blade of a cutting implement.

BACKGROUND

In many fields, various types of cutting implements are used to cut, score, and/or trim articles on a daily basis. Cutting implements often include a sheathing device to protect the blade from damage and to prevent accidental cutting of a user or another object that contacts the blade. One problem with these cutting implements is that the blade must be removed from the sheathing device so that the blade can be used. Another problem with removable sheathing devices is that they must be set aside during use of the cutting implement and the blade must be recovered at the conclusion of the cutting task.

Often times, the sheathing device may be lost and the cutting implement stored with the blade uncovered. This is particularly common among precision knives having a very sharp blade and a small removable sheathing device that covers the entire blade. This can lead to an unaware user being accidentally cut by the blade. Furthermore, the user may be at risk of being cut by the blade during use of the cutting implement. For example, the user's finger may slip or slide over the cutting edge or tip of the blade during use or during removal and replacement of the blade.

Accordingly, those skilled in the art continue with research and development efforts in the field of cutting blade safety.

SUMMARY

In one embodiment, the disclosed blade cover may include a cover body defining an interior volume, the cover body being configured to receive a cutting implement within the interior volume, a recess is disposed in the cover body, and a slot is disposed through the recess, the slot defining an opening into the interior volume, wherein the slot is configured to receive at least a portion of a blade of the cutting implement and the recess is configured to expose at least a portion of the blade of the cutting implement.

In another embodiment, the disclosed blade cover may include a cutting implement including a handle and a blade connected to the handle, the blade including a cutting edge, and a cover body defining an interior volume configured to receive at least the blade, the cover body including a recess and a slot disposed through the recess, wherein the slot is configured to receive at least a portion of the cutting edge and the recess is configured to expose at least a portion of the blade proximate the cutting edge.

In another embodiment, also disclosed is a method for cutting, the method may include the steps of: (1) providing a cutting implement including a handle and a blade connected to the handle, the blade including a cutting edge, (2) providing a blade cover including a cover body defining an interior volume, the cover body including a recess and a slot disposed through the recess, (3) receiving at least the blade within the interior volume of the cover body, (4) receiving at least a portion of the cutting edge within the slot, (5) exposing at least a portion of the blade through the recess, and (6) cutting an article with an exposed portion of the cutting edge.

Other embodiments of the disclosed blade cover will become apparent from the following detailed description, the accompanying drawings and the appended claims.

DETAILED DESCRIPTION

Figure 1:
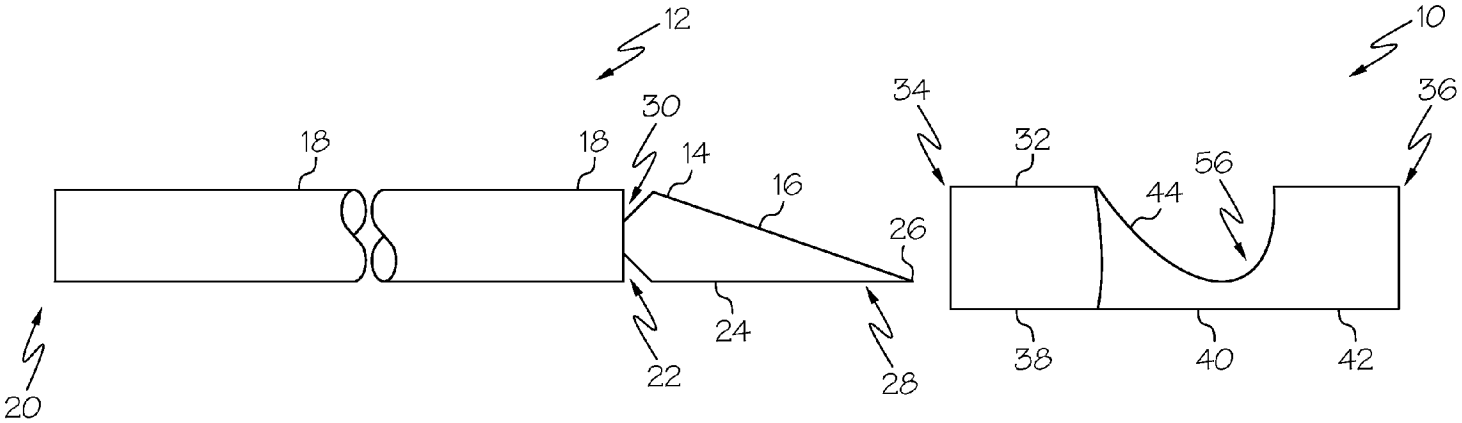
FIG. 1 is a side elevational view of one embodiment of the disclosed blade cover depicted removed from a cutting implement.

The following detailed description refers to the accompanying drawings, which illustrate specific embodiments of the disclosure. Other embodiments having different structures and operations do not depart from the scope of the present disclosure. Like reference numerals may refer to the same element or component in the different drawings.

Figure 2:
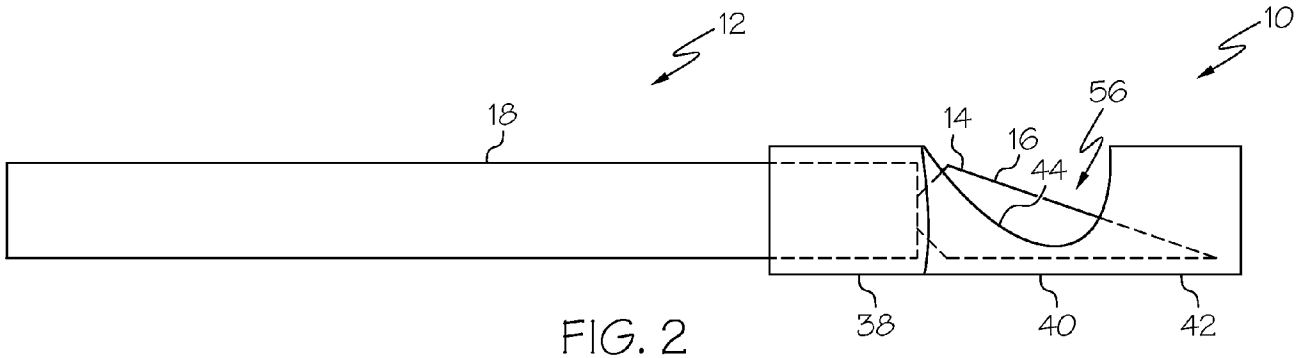
FIG. 2 is a side elevational view of the disclosed blade cover of FIG. 1 depicted connected to a cutting implement.

Referring to FIGS. 1 and 2, the disclosed blade cover, generally designated 10, may be configured to connect to a cutting implement 12 and cover a blade 14 of the cutting implement 12. The blade cover 10 may be configured to expose at least a portion of a cutting edge 16 of the blade 14 upon being connected to the cutting implement 12.

Those skilled in the art will appreciate that the cutting implement 12 may be any type of cutting tool, such as a utility knife, a hobby knife, a small-scale precision knife, and the like. As one example, the cutting implement 12 may be a precision knife, such as an X-ACTO® brand knife commercially available from Elmer's Products, Inc. of Columbus, Ohio. As another example, the cutting implement 12 may be a precision knife, such as a scalpel.

The cutting implement 12 may include a handle 18. For example, the handle 18 may include a pen-like body having a first end (e.g., grip end) 20, a longitudinally opposed second end (e.g., blade end) 22, a length, a cross-sectional shape (e.g., circular or rectangular), and a cross-sectional dimension (e.g., diameter or thickness). The handle 18 may have a consistent cross-sectional shape and dimension along its length or the cross-sectional shape and dimension may vary along its length.

The blade 14 may extend from the second end 22 of the handle 18. The blade 14 may be attached (e.g., integrally) to the second end 22 of the handle 18 or may be connected (e.g., removably) to the second end 22 of the handle 18 by a releasable fitting. The blade 14 may include a sharpened cutting edge 16 and an unsharpened back edge 24. The cutting edge 16 may include a straight edge (e.g., an X-ACTO® blade) or may include a curved edge (e.g., a scalpel or lancet blade). The cutting edge 16 and the back edge 24 may intersect at a forward-most end 28 and terminate at a sufficiently sharp point 26. A rear end 30 of the blade 14 may be longitudinally spaced from the forward-most end 28. The rear end 30 may include a stem (not shown). The second end 22 of the handle 18 may be configured to receive and retain the stem for connection of the blade 14 to the handle 18.

Figure 3:
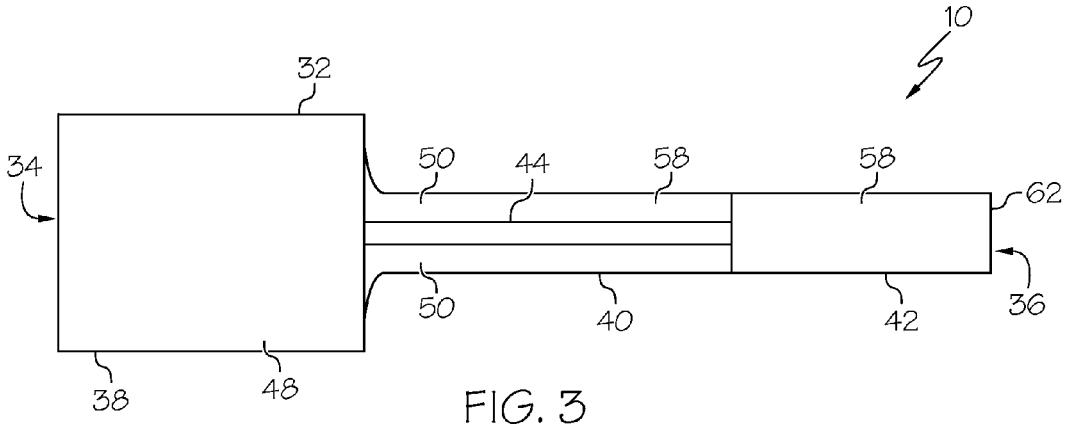
FIG. 3 is a top plan view of the disclosed blade cover.
Figure 4:
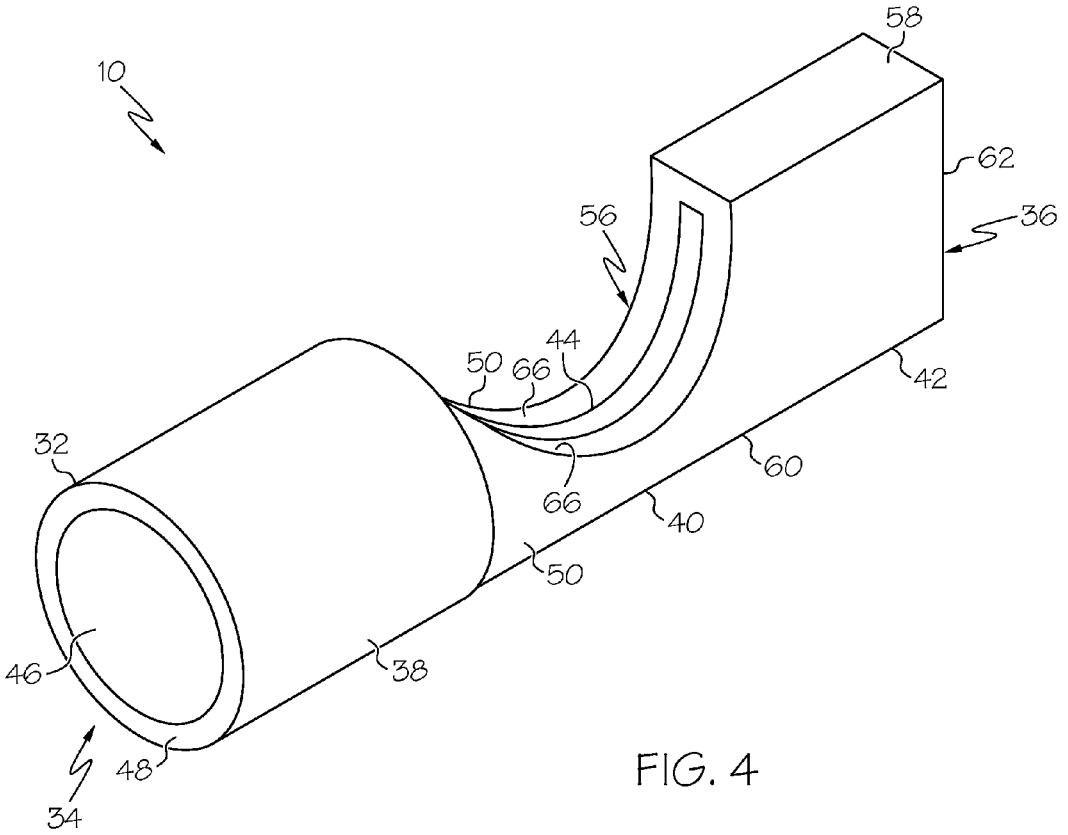
FIG. 4 is side and rear perspective view of the disclosed blade cover.
Figure 5:
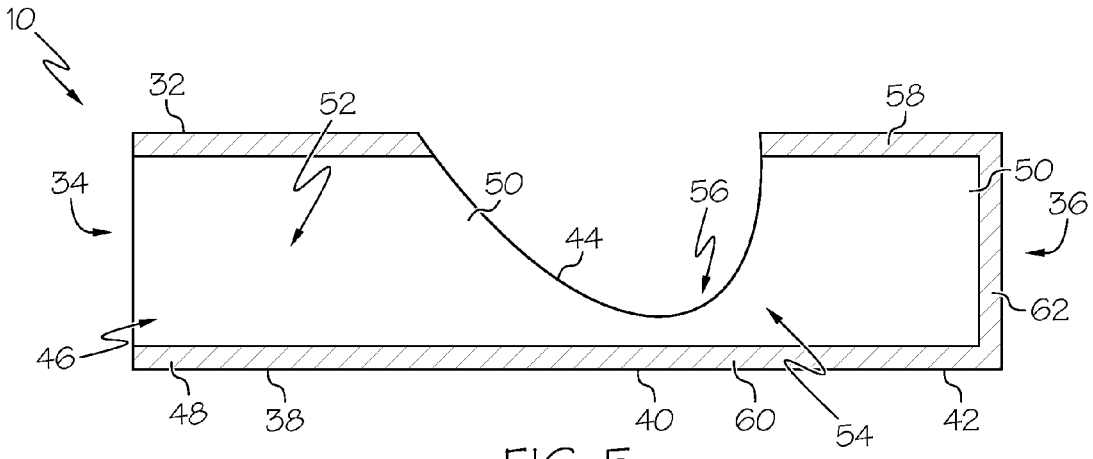
FIG. 5 is a side elevational view, in section, of the disclosed blade cover.

Referring to FIGS. 3-5, the blade cover 10 may include a tubular cover body 32 defining an open interior volume 46 (FIG. 5). The cover body 32 may include a first end 34 and a second end 36, the second end 36 being longitudinally spaced from the first end 34. The cover body 32 may be made from any substantially rigid, semi-rigid, or resilient material of sufficient strength to support the shape of the cover body 32, such as thermoplastic, natural or synthetic rubber, and the like. However, other materials, such as metallic materials, are also contemplated.

The cover body 32 may include a handle cover portion 38, a blade cover portion 40, and a grip portion 42. The handle cover portion 38 may extend from proximate the first end 34 to proximate the blade cover portion 40. The blade cover portion 40 may extend from the handle cover portion 38 to proximate the grip portion 42. The grip portion 42 may extend from the blade cover portion 38 to proximate the second end 36.

In an example construction, the cover body 32 and the interior volume 46 may substantially match the shape of the second end 22 of the handle 12 and the blade 14. In another example construction, the entire cover body 32 may be elongated and substantially circular in cross-section. Although, those skilled in the art will appreciate that the cover body 32 may have any cross-sectional shape including, but not limited to, square, rectangular, ovular, and the like.

For example, the handle cover portion 38 of the body 32 may include a substantially circular cross-sectional shape formed by a sidewall 48 (e.g., a continuous sidewall) defining a first portion 52 (FIG. 5) of the interior volume 46 having a substantially circular cross-sectional shape suitable to receive the second end 22 of the handle 12. The handle cover portion 38 may include a length sufficient to receive at least a portion of the second end 22 of the handle 12. For example, the handle cover portion 38 may receive at least 5 percent of the handle 12. As another example, the handle cover portion 38 may receive at least 10 percent of the handle 12.

As a specific non-limiting example, the handle cover portion 38 of the body 32 may be between approximately 25 millimeters and 50 millimeters in length. As another specific non-limiting example, the handle cover portion 38 of the body 32 may be approximately 30.5 millimeters in length.

The first portion 52 of the interior volume 46 (e.g., interior volume of the handle cover portion 38) may include dimensions (e.g., diameter) sufficient to engage an exterior surface of the handle 12 (e.g., proximate the second end 22). For example, the cross-sectional dimensions of the second portion 52 of the interior volume 46 may be slightly greater than and in close tolerance with the cross-sectional dimensions of the second end 22 of the handle 12 sufficient to provide an interference fit (e.g., friction fit).

As another example, the cross-sectional dimensions of the first portion 52 of the interior volume 46 may be slightly less than the cross-sectional dimensions of the second end 22 of the handle 12 such that the handle cover portion 38 expands upon insertion of the second end 22 of the handle 12 sufficient to provide a compression fit.

The body 32 may transition from the handle cover portion 38 to the blade cover portion 40 and the grip portion 42. The blade cover portion 40 and the grip portion 42 may include a substantially rectangular cross-sectional shape formed by a pair of substantially parallel and spaced apart sidewalls 50 defining a second portion 54 (FIG. 5) of the interior volume 46 having a substantially rectangular cross-sectional shape suitable to fully receive the blade 14. The second portion 54 of the interior volume 46 may include cross-sectional dimensions (e.g., length, width, and height) sufficient to receive the entire body of the blade 14. For example, the cross-sectional dimensions of the second portion 54 may be between approximately 20 millimeters and 50 millimeters in length, between approximately 3 millimeters and 15 millimeters in width, and between approximately 0.5 millimeters and 1 millimeter in thickness, depending upon the length, width, and thickness of the blade 14.

For example, the blade cover portion 40 may receive (e.g., cover over) at least 50 percent of the length of the blade 14 and the grip portion 42 may receive (e.g., cover over) at least 50 percent of the length of the blade 14 (e.g., proximate the forward-most end 28). As another example, the blade cover portion 40 may receive at least 70 percent of the length of the blade 14 and the grip portion 42 may receive at least 30 percent of the length of the blade 14. As another example, the blade cover portion 40 may receive at least 80 percent of the length of the blade 14 and the grip portion 42 may receive at least 20 percent of the length of the blade 14. As another example, the blade cover portion 40 may receive at least 90 percent of the length of the blade 14 and the grip portion 42 may receive at least 10 percent of the length of the blade 14 (e.g., only the portion of the blade 14 proximate the point 26).

As a specific non-limiting example, the blade cover portion 40 of the body 32 may be between approximately 10 millimeters and 45 millimeters in length and the grip portion 42 may be between approximately 5 millimeters and 20 millimeters in length, depending upon the length of the blade 14. The blade cover portion 40 and the grip portion 42 may be between approximately 5 millimeters and 20 millimeters in width, depending upon the width of the blade 14. As another specific non-limiting example, the blade cover portion 40 of the body 32 may be approximately 15.24 millimeters in length and the grip portion 42 may be approximately 15.24 millimeters in length. The blade cover portion 40 and the grip portion 42 may be approximately 12.7 millimeters in width.

The grip portion 42 (e.g., the width of a portion of the sidewalls 50 forming the grip portion 42) may include a width greater than the width of the blade cover portion 40

(e.g., the width of a portion of the sidewalls 50 forming the blade cover portion 40) in order to provide a larger surface area configured to be gripped by a user.

The spaced apart distance between the pair of sidewalls 50 may define the thickness dimension of the second portion 54 of the interior volume 48. For example, the second portion 54 of the interior volume 48 may be dimensioned in close tolerance to the dimensions of the blade 14 in order to reduce (in not eliminate) bending, flexing, and/or rotation of the blade 14 relative to the handle 18. As another example, the second portion 54 may be dimensioned larger than the dimensions of the blade 14.

The blade cover 10 may include a longitudinal slot 44. The slot 44 may extend from proximate the handle cover portion 38 to proximate the grip portion 42. For example, the slot 44 may extend substantially the length of the blade cover portion 40. The slot 44 may be suitably sized to receive the blade 14 such that at least a portion of the cutting edge 16 extends therethrough upon the cover body 32 being connected to the cutting implement 12. For example, the slot 44 may receive at least approximately 25 percent of the cutting edge 16. As another example, the slot 44 may receive at least approximately 50 percent of the cutting edge 16. As another example, the slot 44 may receive at least approximately 75 percent of the cutting edge 16. As another example, the slot 44 may receive at least approximately 90 percent of the cutting edge 16.

For example, the slot 44 may be between approximately 20 millimeters and 50 millimeters in length and between approximately 0.5 millimeters and 0.1 millimeter in width, depending upon the length and thickness of the blade 14.

In an example embodiment, the cover body 32 may include a first wall 58 (e.g., proximate the cutting edge 16 of the blade 14) extending laterally between the pair of sidewalls 50 forming the blade cover portion 40 and the grip portion 42. A second wall 60 (e.g., proximate the back edge 24 of the blade 14) may extend laterally between the pair of sidewalls 50 forming the blade cover portion 40 and the grip portion 42 opposite the first wall 58.

In an example construction, the slot 44 may be disposed through the first wall 58. As another example embodiment, the slot 44 may be defined by the lateral distance between the pair of sidewalls 50 forming the blade cover portion 40 (e.g., the thickness dimension of the second portion 54 of the interior volume 48), such that no first wall 58 is present.

The blade cover 10 may include a recess 56. The recess 56 may be an indentation in the cover body 32 extending from proximate the handle cover portion 38 to proximate the grip portion 42. For example, the recess 56 may extend substantially the length of the blade cover portion 40. The recess 56 may extend toward the second portion 54 of the interior volume 48. The slot 44 may be disposed through and be aligned with the recess 56. The slot 44 may define an opening from the second portion 54 of the interior volume 46 to the recess 56.

The recess 56 may include any size and shape suitably configured to expose at least a portion of a surface area of opposed major surfaces of the blade 14 (e.g., sides of the blade proximate the cutting edge 16) upon the blade cover 10 being connected to the cutting implement 12. An orthogonal side profile of the shape of the recess 56 may be defined by a surface 66 of the sidewalls 50 and/or the first wall 58, depending upon the construction of the cover body 32, as expressed above. The slot 44 may include a profile shape substantially the same as the profile shape of the recess 56.

For example, the recess 56 may extend into the pair of sidewalls 50 forming the blade cover portion 40 from the first wall 58 (FIG. 3) toward the second wall 60 (e.g., from the cutting edge 16 toward the back edge 24 of the blade 14, when the blade cover 10 is connected to the cutting implement 12).

As another example, the recess 56 may extend into the pair of sidewalls 50 forming the blade cover portion 40 from a surface 66 (FIG. 4) proximate the slot 44 (e.g., a surface extending laterally between a pair of opposed major longitudinal surfaces defining each sidewall 50) toward the second wall 60 (e.g., from the cutting edge 16 toward the back edge 24 of the blade 14, when the blade cover 10 is connected to the cutting implement 12).

In an example construction, the recess 56 may be configured to expose a portion of the width of the blade 14 and a portion of the length of the blade 14 extending through the slot 44 (e.g., a portion of the surface area of the side of the blade 14 between the forward-most end 28 and the rear end 30). For example, the recess 56 may expose up to 10 percent of the surface area of the blade 14. As another example, the recess 56 may expose up to 25 percent of the surface area of the blade 14. As another example, the recess 56 may expose up to 50 percent of the surface area of the blade 14. As another example, the recess 56 may expose up to 75 percent of the surface area of the blade 14.

In an example construction, the recess 56 may be configured to expose a portion of the length of the cutting edge 16 extending through the slot 44 (e.g., a portion of the length of the cutting edge 16 of the blade 14 between the forward-most end 28 and the rear end 30). For example, the recess 56 may expose up to 10 percent of the length of the cutting edge 16. As another example, the recess 56 may expose up to 25 percent of the length of the cutting edge 16. As another example, the recess 56 may expose up to 50 percent of the length of the cutting edge 16. As another example, the recess 56 may expose up to 75 percent of the length of the cutting edge 16.

As another example embodiment, the cover body 32 may include a third wall 62 (e.g., proximate the point 26 of the blade 14) extending laterally between the pair of sidewalls 50 forming the grip portion 42. The third wall 62 may cover the point 26 of the blade 14 and limit movement of the body 32 along the handle 18 (e.g., toward the first end 20) of the cutting implement 12.

Each sidewall of the pair of sidewalls 50 may include a substantially flat exterior major surface. Upon the blade cover 10 being connected to the cutting implement 12, the flat surface of the sidewalls 50 may limit (if not prevent) rotation (e.g. rolling) of the cutting implement 12 when placed on a work surface (e.g., a table).

Figure 6:
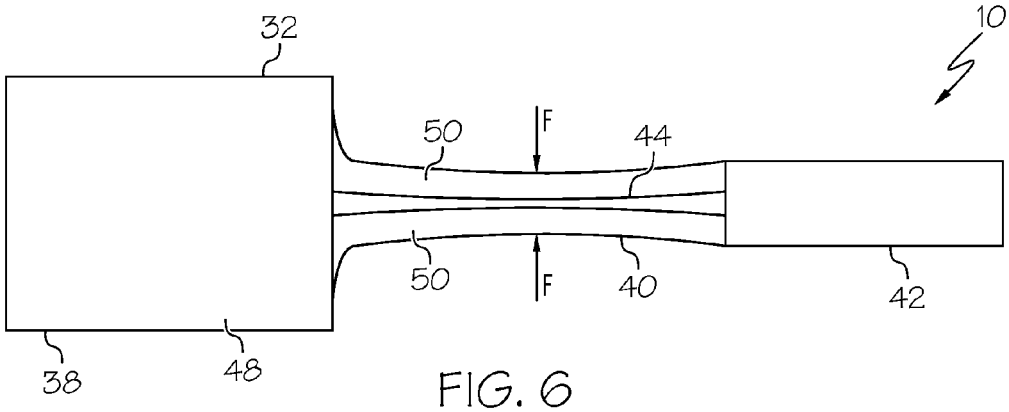
FIG. 6 is top plan view of the disclosed blade cover depicting deflection in response to an applied compressive force.

Referring to FIG. 6, the grip portion 42 and/or the blade cover portion 40 may be configured to allow the sidewalls 50 to deflect inwardly (e.g., toward one another) in response to a compressive force F applied to the sidewalls 50. For example, at least a portion of the sidewalls 50 forming the grip portion 42 and/or the blade cover portion 40 may be made of a semi-flexible and resilient material sufficient to allow deflection and then return to an original (e.g., non-deflected) state. Application of the compressive force F (e.g., by squeezing the sidewalls 50 between the thumb and forefinger of a user) may allow the blade 14 to be retained within the blade cover 10 during removal of the blade 14 from the handle 18.

Figure 7:
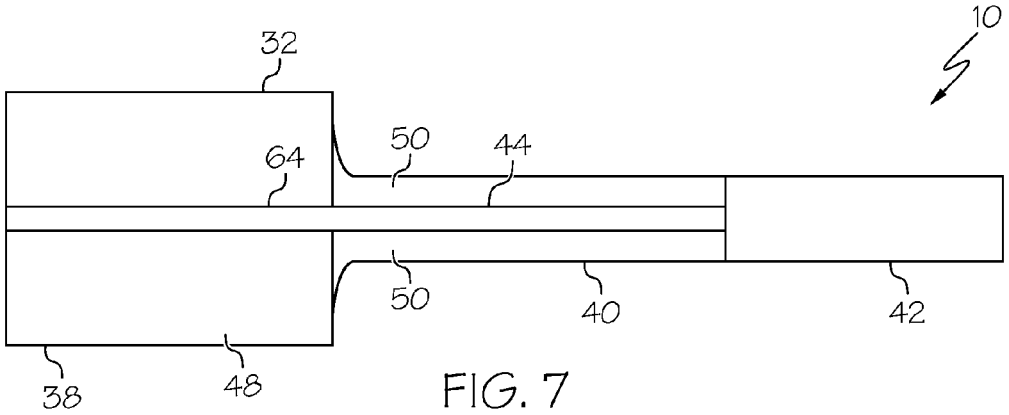
FIG. 7 is top plan view of another embodiment of the disclosed blade cover.

Referring to FIG. 7, as another example embodiment, the sidewall 48 forming the handle cover portion 38 may include a split 64 extending from proximate the first end 34 to proximate the blade cover portion 40. The split 64 may allow the handle cover portion 38 to expand to receive the second end 22 of the handle 18. For example, at least a portion of the sidewall 48 forming the handle cover portion 38 may be made of a semi-flexible and resilient material sufficient to allow expansion and then return to an original (e.g., non-expanded) state. The sidewall 48 may compress the exterior of the handle 18 upon the second end 22 being inserted within the first portion 52 of the interior volume 46 and return to the original state. The split 64 may be longitudinally aligned with the slot 44. For example, the split 64 may extend to or be part of the slot 44.

Referring to FIGS. 8-11, the recess 56 may include any shape (e.g., the profile of the recess 56 in side elevational view) and/or size sufficient to expose a portion of the blade 14. The exposed width of the blade 14 at any point along the exposed length of the cutting edge 16 may depend upon the size and shape of the recess 56 as well as the size and shape of the blade 14.

Figure 8:
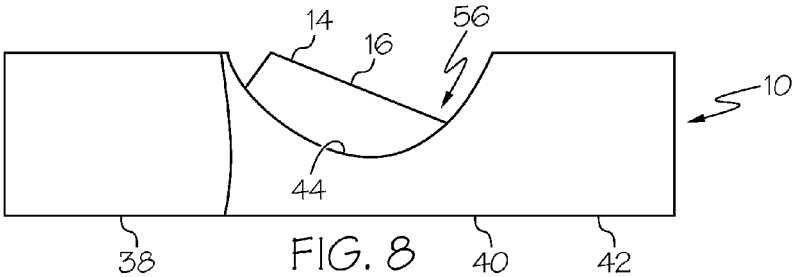
FIG. 8 is a side elevational view of another embodiment of the disclosed blade cover.
Figure 9:
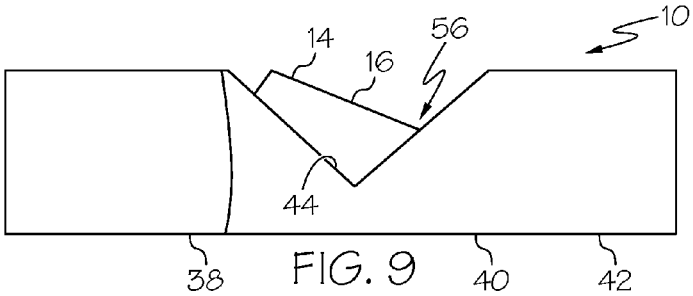
FIG. 9 is a side elevational view of another embodiment of the disclosed blade cover.
Figure 10:
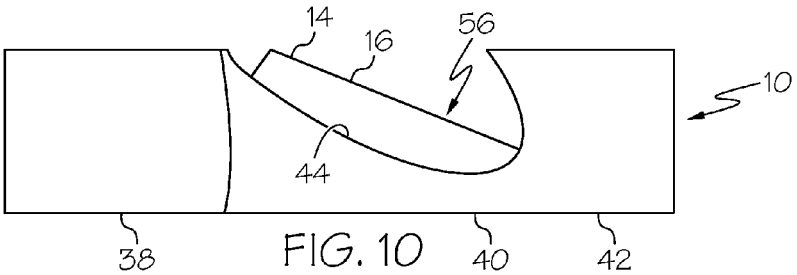
FIG. 10 is a side elevational view of another embodiment of the disclosed blade cover.
Figure 11:
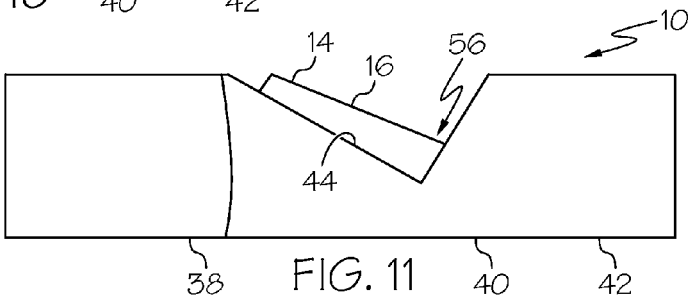
FIG. 11 is a side elevational view of another embodiment of the disclosed blade cover.
Figure 12:
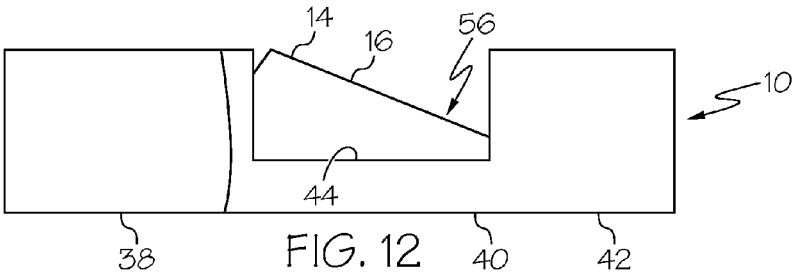
FIG. 12 is a side elevational view of another embodiment of the disclosed blade cover.

For example, the recess 56 may include a symmetrical shape having a profile defined by a curved line (e.g., U-shaped), as illustrated in FIG. 8. As another example, the recess 56 may include a symmetrical shape having a profile defined by a pair of straight lines intersecting one another at a non-zero angle (e.g., V-shaped), as illustrated in FIG. 9. As another example, the recess 56 may include an unsymmetrical shape having a profile defined by a curved line, as illustrated in FIG. 10. As another example, the recess 56 may include an unsymmetrical shape having a profile defined by a pair of straight lines intersecting one another at a non-zero angle, as illustrated in FIG. 11. As another example, the recess 56 may include a symmetrical shape having a profile defined by three perpendicularly intersecting straight lines (e.g., rectangular-shaped), as illustrated in FIG. 12. As another example, the recess 56 may include an unsymmetrical shape having a profile defined by three or more straight lines intersecting one another at a non-zero angle (not shown). As still another example, the recess 56 may include an unsymmetrical shape having a profile defined by be one or more intersecting straight lines and/or one or more curved lines (not shown). Those skilled in the art will appreciate that the shape of the recess 54 may have any profile.

Figure 13:
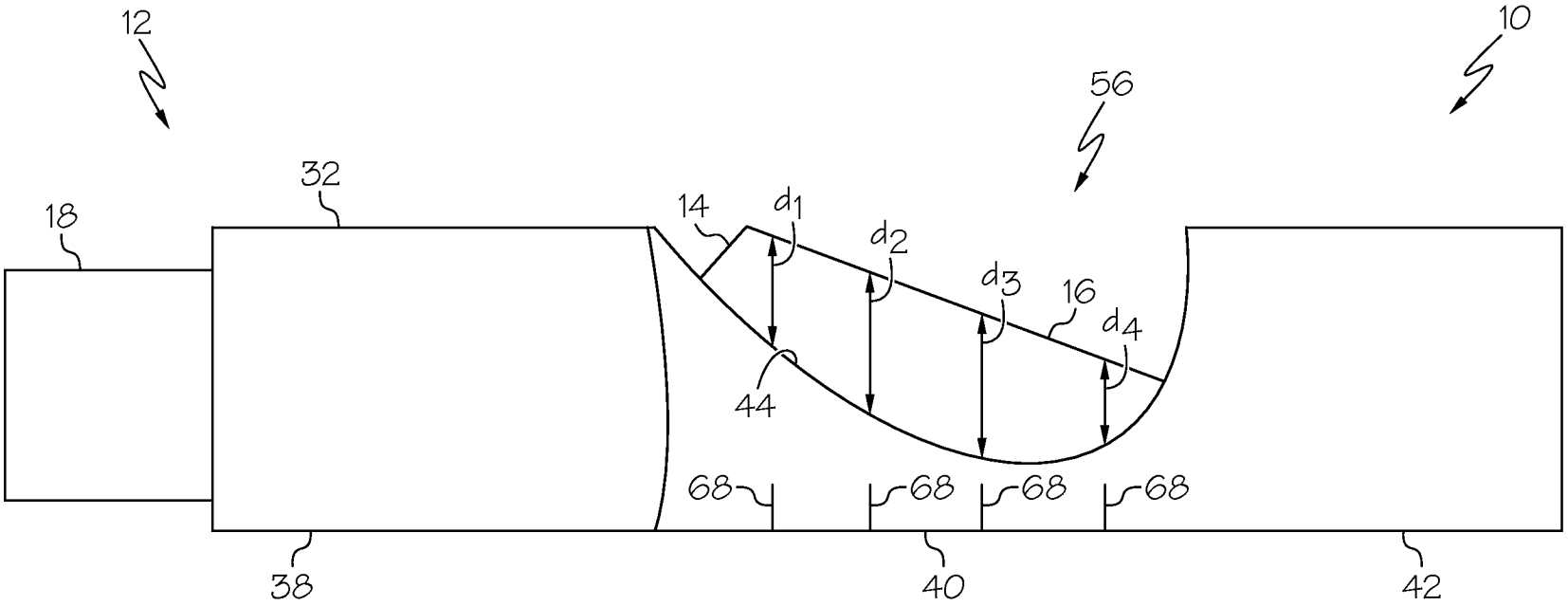
FIG. 13 is a side elevational view of another embodiment of the disclosed blade cover.

Referring to FIG. 13, in another embodiment, the recess 54 may be configured to act as a cutting depth guide. In certain applications, such as when scoring wire sheathing, limiting a cutting depth d of the blade 14 may be beneficial. The recess 56 may be suitably sized and shaped to expose a predetermined width of the blade 14 at a predetermined location along the exposed length of the cutting edge 16, such that the sidewalls 50 forming the blade covering portion 40 limit the cutting depth d of the blade 14.

In an example construction, the recess 56 may be configured to provide a plurality of different cutting depths $d_1$-$d_4$ at different locations along the exposed length of the cutting edge 16. As another example construction, the recess 56 may be configured to provide a single cutting depth d at all locations along the exposed length of the cutting edge 16.

One or both of the sidewalls 50 may include a plurality of cutting depth indicia 68 corresponding to and identifying a respective cutting depth d. Each cutting depth d may be defined by a length measurement unit or by a wire gauge unit. Accordingly, each indicium 68 may indicate a length or a wire gauge corresponding to a respective cutting depth d.

Figure 14:
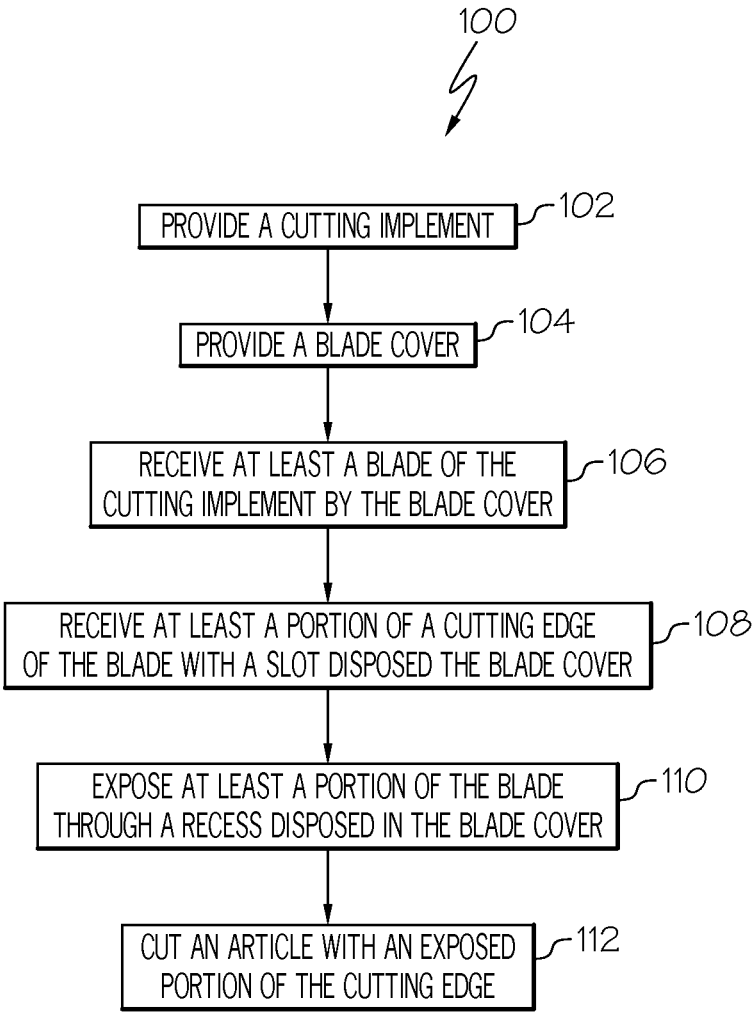
FIG. 14 is a flow diagram of one embodiment of a method for cutting.

Referring to FIG. 14, also disclosed is a method, generally designated 100, for cutting. As shown at block 102, the method 100 may begin by providing a cutting implement 12 including at least a handle 18 and a blade 14 connected to the handle 18 (FIG. 1).

As shown at block 104, a blade cover 10 may be provided. The blade cover 10 may include a cover body 32 defining an interior volume 48. The cover body 32 may include a recess 56 and a slot 44 disposed through the recess 56 (FIGS. 1 and 5).

As shown at block 106, at least the blade 14 of the cutting implement 12 may be received within the interior volume 48 of the cover body 32 (FIG. 2).

As shown at block 108, at least a portion of the cutting edge 16 of the blade 14 may be received within the slot 44.

As shown at block 110, at least a portion of the blade 14 may be exposed through the recess 56.

As shown at block 112, an article (not shown) may be cut with an exposed portion of the cutting edge 16.

Accordingly and with reference to FIGS. 1 and 2, the disclosed blade cover 10 may provide a safety cover for the blade 14 of a cutting implement 12 (e.g., an X-ACTO® knife). The blade cover 10 may include a cover body 32 configured to cover a portion of the cutting edge 16 and the point 26 of the blade 14 in order to protect a user from accidental injury. The cover body 32 may include a slot 44 and a recess 56 configured to expose at least a portion of the cutting edge 16 of the blade 14, such that an article (not shown) may be cut with the exposed portion of the cutting edge 16 (e.g., scoring wire) while offering added safety protection to the user.

Further and with reference to FIG. 13, the recess 56 may be configured to provide a cutting depth guide. Upon connection of the blade cover 10 to the cutting implement 12, the recess 56 may be displaced from the cutting edge 16 at one or more predetermined distances (e.g., cutting depths d). Furthermore and with reference to FIG. 6, at least a portion of the cover body 32 (e.g., sidewalls 50) may be configured to deflect inwardly toward the blade 14 in order to safely remove (e.g., disconnect) the blade 14 from the handle 18 when replacement of the blade 14 is required.

Figure 15:
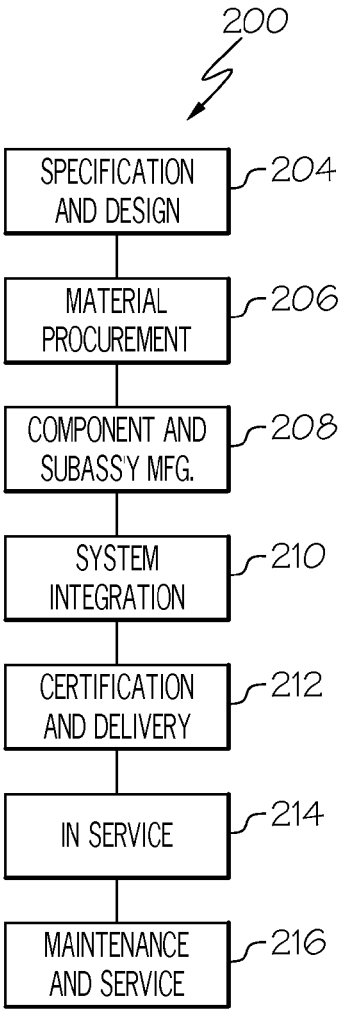
FIG. 15 is a flow diagram of aircraft production and service methodology.
Figure 16:
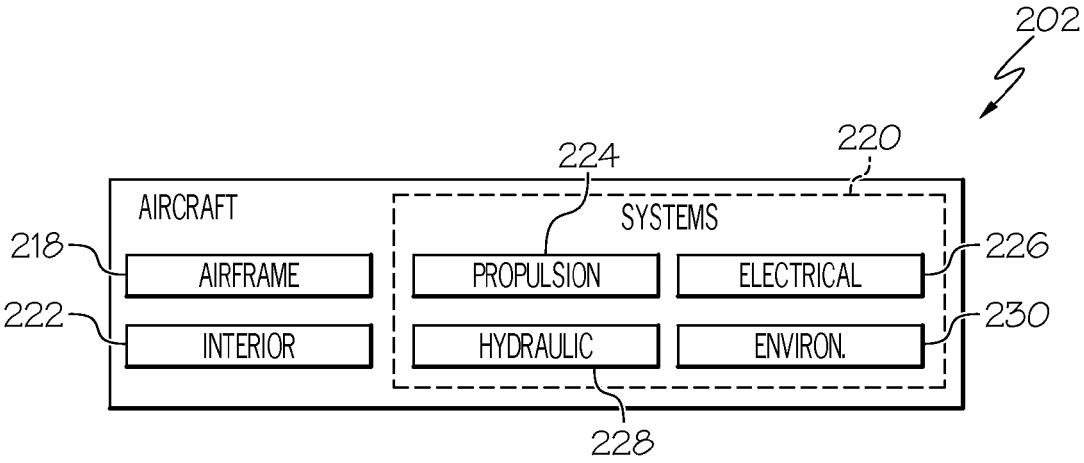
FIG. 16 is a block diagram of an aircraft.

Examples of the disclosure may be described in the context of an aircraft manufacturing and service method 200, as shown in FIG. 15, and an aircraft 202, as shown in FIG. 16. During pre-production, example method 200 may include specification and design 204 of the aircraft 202 and material procurement 206. During production, component and subassembly manufacturing 208 and system integration 210 of the aircraft 202 takes place. Thereafter, the aircraft 202 may go through certification and delivery 212 in order to be placed in service 214. While in service by a customer, the aircraft 202 is scheduled for routine maintenance and service 216, which may also include modification, reconfiguration, refurbishment and the like.

Each of the processes of method 200 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 16, the aircraft 202 produced by example method 200 may include an airframe 218 with a plurality of systems 220 and an interior 222. Examples of high-level systems 220 include one or more of a propulsion system 224, an electrical system 226, a hydraulic system 228, and an environmental system 230. Any number of other systems may be included. Although an aerospace example is shown, the principles of the invention may be applied to other industries, such as the automotive industry.

The blade cover and method disclosed herein may be employed during any one or more of the stages of the production and service method 200. For example, components or subassemblies corresponding to production process 208 may be fabricated or manufactured in a manner similar to components or subassemblies produced while the aircraft 202 is in service. Also, one or more apparatus examples, method examples, or a combination thereof may be utilized during the production stages 208 and 210, for example, by substantially expediting assembly of or reducing the cost of an aircraft 202. Similarly, one or more of apparatus examples, method examples, or a combination thereof may be utilized while the aircraft 202 is in service, for example and without limitation, to maintenance and service 216.

Although various embodiments of the disclosed blade cover have been shown and described, modifications may occur to those skilled in the art upon reading the specification. The present application includes such modifications and is limited only by the scope of the claims.

What is claimed is:

1. A blade cover for a cutting implement comprising a handle having a circular cross section and a blade coupled to an end of said handle, said blade cover comprising:

a cover body defining an interior volume, said cover body comprising a handle cover portion to receive at least a portion of said end of said handle of said cutting implement and a blade cover portion extending from said handle cover portion to at least partially surround said blade of said cutting implement;

a slot disposed through said blade cover portion of said cover body to receive and expose at least a portion of a cutting edge of said blade of said cutting implement upon said cover body being connected to said cutting implement;

a recess formed in said blade cover portion of said cover body and intersecting said slot, wherein said recess comprises a profile shape depending downwardly from said cutting edge of said blade to expose at least a portion of side surfaces of said blade of said cutting implement extending through said slot upon said cover body being connected to said cutting implement, and wherein said profile shape is disposed at a plurality of predetermined distances below said cutting edge of said blade at different locations along a length of said slot corresponding to a plurality of predefined cutting depths to form a variable cutting depth guide; and a plurality of cutting depth indicia disposed on said blade cover portion corresponding to and identifying each of said plurality of predetermined cutting depths of said cutting depth guide.

2. The blade cover of claim 1 wherein each one of said predetermined cutting depths of said cutting depth guide is different.

3. The blade cover of claim 1 wherein said profile shape of said recess comprises an unsymmetrical curved line.

4. The blade cover of claim 1 wherein said profile shape of said recess comprises a pair of straight lines intersecting each other at a non-zero angle.

5. The blade cover of claim 1 wherein said slot is configured to expose at least 50 percent of said cutting edge of said blade.

6. The blade cover of claim 1 wherein said slot is configured to expose at least 25 percent of said cutting edge of said blade.

7. The blade cover of claim 1 wherein said profile shape of said recess is configured to expose at least 25 percent of said side surfaces of said blade.

8. The blade cover of claim 1 wherein said profile shape of said recess is configured to expose at least 50 percent of said side surfaces of said blade.

9. The blade cover of claim 1 wherein said profile shape of said recess comprises three perpendicularly intersecting straight lines.

10. The blade cover of claim 1 wherein:

said handle cover portion has a circular cross section configured to completely surround at least a portion of said end of said handle of said cutting implement, said handle cover portion defines a first portion of said interior volume, said first portion of said interior volume being configured to receive a portion of said handle of said cutting implement proximate said end of said handle; and said blade cover portion defines a second portion of said interior volume, said second portion of said interior volume being configured to receive said blade of said cutting implement.

11. The blade cover of claim 1 wherein said cover body comprises a grip portion extending from said blade cover portion, said grip portion being configured to receive and completely surround at least a forward-most tip of said blade.

12. The blade cover of claim 11 wherein said blade cover portion and said grip portion comprise at least a pair of spaced apart sidewalls defining said second portion of said interior volume, and wherein said pair of sidewalls is configured to deflect inwardly in response to an applied compressive force, and wherein said pair of sidewalls engage said blade upon deflection.

13. The blade cover of claim 1 wherein at least one of said predetermined cutting depths of said cutting depth guide is different from at least another one of said predetermined cutting depths of said cutting depth guide.

14. A blade cover for a cutting implement comprising a handle and a blade coupled to said handle, said blade cover comprising:

a cover body defining an interior volume configured to receive at least a portion of said handle and said blade; said cover body comprising:

a slot disposed through said cover body to receive and expose at least a portion of a cutting edge of said blade of said cutting implement upon said cover body being connected to said cutting implement; and a recess formed in said cover body and intersecting said slot, wherein said recess comprises a profile shape depending downwardly from said cutting edge of said blade to expose at least a portion of side surfaces of said blade of said cutting implement extending through said slot upon said cover body being connected to said cutting implement, and wherein said profile shape is disposed at a plurality of predetermined distances below said cutting edge of said blade at different locations along a length of said slot corresponding to a plurality of predefined cutting depths to form a cutting depth guide; and a plurality of cutting depth indicia disposed on an exterior of said cover body corresponding to and identifying said plurality of predetermined cutting depths of said cutting depth guide.

15. The blade cover of claim 14 wherein said profile shape of said recess comprises an unsymmetrical curved line.

16. The blade cover of claim 14 wherein said profile shape of said recess comprises at least two straight lines intersecting each other at a non-zero angle.

17. The blade cover of claim 14 wherein at least one of said predetermined cutting depths of said cutting depth guide is different from at least another one of said predetermined cutting depths of said cutting depth guide.

18. The blade cover of claim 14 wherein said cover body is configured to deflect inwardly in response to an applied compressive force, and wherein said cover body engages said blade upon deflection.

19. A method for cutting, said method comprising:

providing a cutting implement comprising a handle having a circular cross section and a blade connected to an end of said handle, said blade comprising a cutting edge;

providing a blade cover comprising:

a cover body comprising a handle cover portion and a blade cover portion extending from said handle cover portion;

a slot disposed through said cover body;

a recess formed in said cover body and intersecting said slot, wherein said recess comprises a profile shape depending downwardly from said cutting edge of said blade, and wherein said profile shape is disposed at a plurality of predetermined distances below said cutting edge of said blade at different locations along a length of said slot corresponding to a plurality of predefined cutting depths to form a variable cutting depth guide; and a plurality of cutting depth indicia disposed on said blade cover portion corresponding to and identifying each of said plurality of predetermined cutting depths of said cutting depth guide;

receiving and at least partially surrounding said blade within said blade cover portion said cover body;

receiving and completely surrounding at least a portion of said end of said handle within said handle cover portion of said cover body;

receiving at least a portion of said cutting edge of said blade within said slot;

exposing at least a portion of side surfaces of said blade along said at least a portion of said cutting edge of said blade through said recess; and cutting an article with said at least a portion of said cutting edge of said blade extending through said slot and exposed by said recess to one of said plurality of predetermined cutting depths using said cutting depth guide.

* * * * *